US005186266A

United States Patent [19]

Heller

[11] Patent Number: 5,186,266

[45] Date of Patent: Feb. 16, 1993

[54] MULTI-WALLED DRILL STRING FOR EXPLORATION-SAMPLING DRILLING SYSTEMS

[76] Inventor: Marion E. Heller, P.O. Box 873, Lewistown, Mont. 59457

[21] Appl. No.: 656,207

[22] Filed: Feb. 15, 1991

[51] Int. Cl.[5] ..... E21B 17/18

[52] U.S. Cl. ..... 175/215; 175/320; 175/405

[58] Field of Search ..... 175/57, 171, 320, 215, 175/71; 285/133.1, 138

[56] References Cited

U.S. PATENT DOCUMENTS

| | | | |
|---|---|---|---|
| 3,323,604 | 1/1967 | Henderson | 175/215 |
| 3,471,177 | 10/1969 | Garrett et al. | 285/133.1 |
| 3,734,209 | 5/1973 | Haisch et al. | 175/171 |
| 4,067,596 | 1/1978 | Kellner et al. | 175/215 |
| 4,100,981 | 7/1978 | Chaffin | 175/215 X |
| 4,194,579 | 3/1980 | Bailey et al. | 175/57 |
| 4,371,046 | 2/1983 | Read | 175/57 |
| 4,691,790 | 9/1987 | Reichman et al. | 175/215 X |
| 4,940,098 | 7/1990 | Moss | 175/320 |

*Primary Examiner*—Ramon S. Britts
*Assistant Examiner*—Frank S. Tsay
*Attorney, Agent, or Firm*—Harry M. Cross, Jr.

[57] ABSTRACT

The drilling system of this invention is specifically adapted to reverse-circulation sample drilling employing a downhole hammer drill. The drilling head configuration provides for simultaneous feeding into a multi-walled drill string with drilling mud, compressed air to operate the hammer drill, to feed the hammer drill head and withdrawing of the return air. The system includes a triple-walled drill rod especially adapted for downhole hammer drilling that eliminates the need for a separate drive casing string.

11 Claims, 11 Drawing Sheets 264
18
262
266
328
330
296
276
280
298
270
273
282
290
284
300
304
292
268
302
294
264
271
310
310
272
286
288
322
21
21
266
324
320
325
328
332
333
326
325
320
330

MULTI-WALLED DRILL STRING FOR EXPLORATION-SAMPLING DRILLING SYSTEMS

RELATED APPLICATION

This is related to application Ser. No. 07/656,219 filed concurrently herewith.

FIELD OF THE INVENTION

This invention relates to drilling systems for mineral exploration sampling; and more particularly to mobile drilling systems for exploration sampling,

BACKGROUND OF THE INVENTION

Exploration drilling of suspected and known mineral deposits is commonly performed in the process of locating and evaluating mineral deposits. In the course of an exploration of a given geography, it is not uncommon to lay out an extensive grid pattern of drill sites, drill hundreds to thousand of mineral-sampling holes as dictated by the grid pattern, and assay the multitude of samples obtained by the sample drilling. Then, based on the assays, overlay another grid pattern and conduct a more extensive drilling of sampling holes. Of course, a likely candidate location must be first identified, often by random, sample drilling, often called "Wildcat drilling." Then the evaluation of the candidate location begins with sample drilling of a wide grid pattern to identify possible minable reserves. The, if further exploration is warranted, sample drilling on a finer grid pattern of the proven minable reserves is conducted for mine planning.

In order to perform this extensive sample drilling, access roads and drilling sites must be located and established. The cutting of access roads and surface drill sites has a very significant impact on the ecology of the surrounding geography. Site and road preparation is costly; and, where required, returning the terrain to its original condition is also costly. This is a major undertaking. Each surface drill site, for example, must have sufficient room for the drill and drill pipe, water pumps, drill rods, drilling mud, storage containers of various types, turn around for the drill rig and other vehicles. Efforts are made, therefore, to provide mobile sample drilling systems in as compact a configuration as possible, while still being capable of meeting the sample drilling requirements.

This can pose problems in that various geological structures may require that different drilling techniques be employed; and a particular drilling rig is not necessarily capable or employing the drilling technique required at a particular site. Oftentimes, a particular exploration project will require the use of more than one drilling technique over the course of the project. Consequently, a driller must have several types of drilling rigs available in order to qualify for the drilling jobs that will become available.

SUMMARY OF THE INVENTION

The system of the present provides a mobile drilling rig that may be mounted on a track undercarriage, a rubber tired undercarriage or on a skid undercarriage. The drilling rig of this invention is not only mobile, it is adjustable for drilling sample holes at various positions around the undercarriage and at various angles with respect to the plane of the undercarriage. The drilling rig of this invention is capable of employing a variety of drilling techniques, such as rotary drilling, percussion drilling, and reverse-circulation drilling. It can recover samples from such diverse structures as rock formations requiring coring and from sands. This drilling rig is therefore capable of drilling in any kind of terrain and through any kind of geological formations that might be encountered in a mineral exploration project.

The drilling system of this invention provides a drill mast mounted on a turntable. The turntable may be mounted on any type of undercarriage or carrier. The drill mast can be positioned around the perimeter of the turntable, it can be positioned near to, or away from, the turntable. The drill mast is carried on a trunnion mounting and can be oriented along Y and Z axis' with respect to the turntable X axis for drilling angle holes. A three-way adjustable control console is provided for operator comfort, regardless of the drilling mast position. Consequently, this drilling system can operate without provision of a drill pad at the drill site. This versatility can result in less extensive, and less expensive, site preparation.

The drilling system provides a drill head with gear reduction that can be set up with two to eight high performance hydraulic motors for varied application and a variable speed rotation. The maximum rotational torque can be varied in increments, as a result, from about 9,000 ft. lbs. to 18,000 ft. lbs., 27,000 ft. lbs. to 36,000 ft. lbs. The drill mast mounts the drill head for a draw works lift force of up to about 88,000 lbs.

The drill mast mounting to the turntable enables the drill mast to be transported laying down over the turn table. The system need not be dismantled for transport from project site to project site. The overall height of the drilling system in its transport mode is low enough for transport on public roadways.

In a preferred embodiment of the drilling system of this invention, a pipe joint breaker assembly is provided adjacent the lower end of the drilling mast. This assembly can accommodate different size pipe diameters.

The drilling systems of this invention is specially adapted to reverse-circulation sample drilling employing a down-the-hole hammer drill. The drilling head configuration provides for simultaneous feeding into a multi-walled drill string of drilling mud, compressed air into the drill string to operate the hammer drill and to feed the hammer drill bit head, and withdrawing of sample-containing return air. The system includes a triple-walled, reverse-circulation drill rod especially adapted for down-the-hole hammer drilling that eliminates the need for a separate drive casing string.

DETAILED DESCRIPTION OF THE INVENTION

Figure 1:
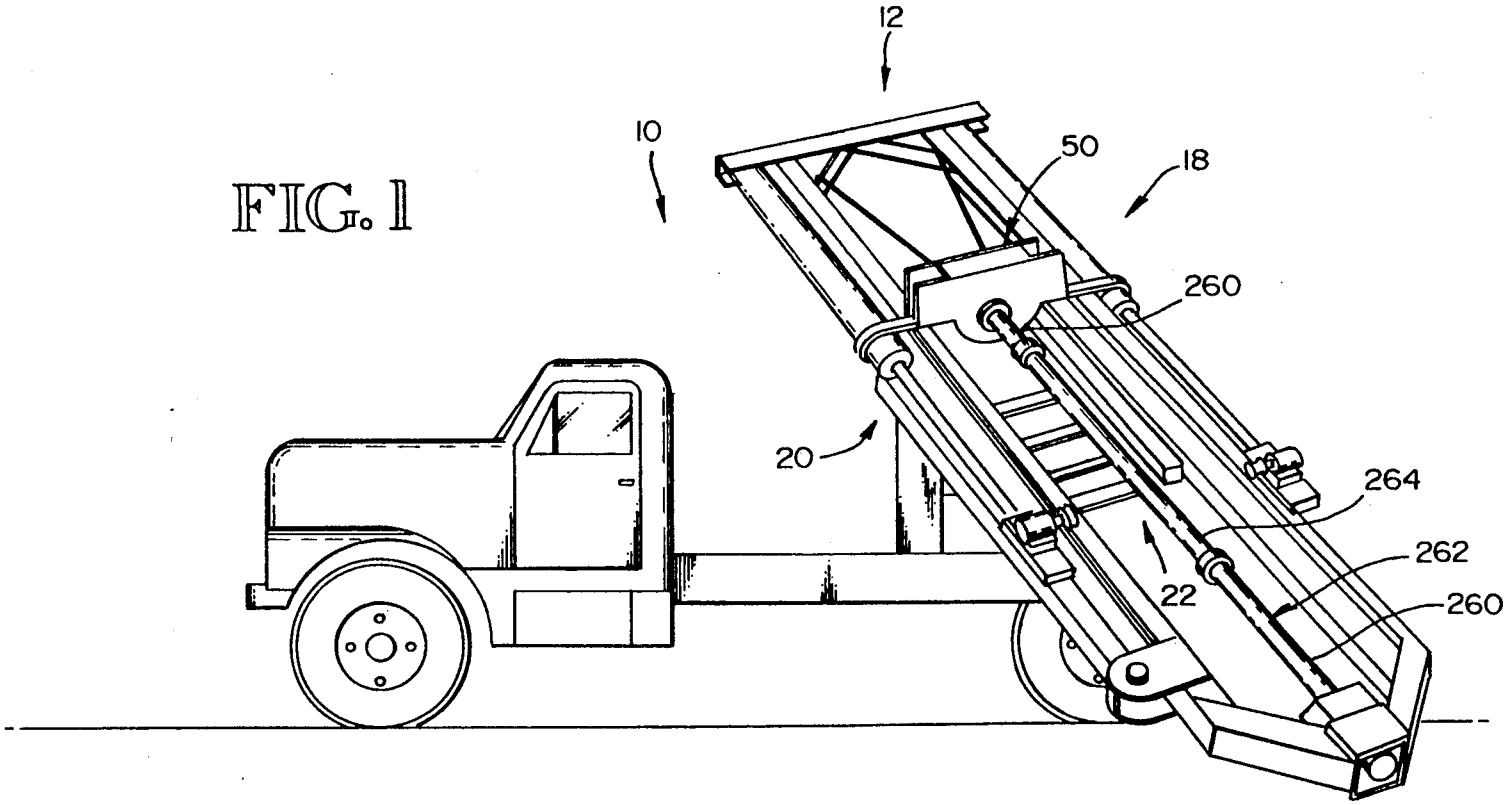
FIG. 1 is a perspective view of the drilling system of this invention, mounted on a truck undercarriage, with the drill mast tilted and angled.

The drilling system of this invention is designed to drill out mineral samples of the kind required in exploration mineral sampling drilling. In this drilling, holes in the range of 4 in. to 7 in. are commonly drilled to depths up to a few thousand feet. Various types of drilling techniques are required, such as rotary drilling, percussive drilling, hammer drilling, and core drilling, depending on the geology of the structure from which the sampling is done. Drill strings composed of drill bit and drill stem sections coupled together, connected to a drill head assembly on the drill mast, are provided in sectional lengths of six to twelve feet. As the drilling operation is conducted, lengths of drill pipe are coupled, during drilling, and uncoupled, during drill string retraction. Consequently, the drilling system of this invention provides a drilling machine configured to accommodate the various drilling techniques. The drilling system of this invention provides a drill head assembly configured to accommodate drill strings required by the various drilling techniques. The drilling system also provides a pipe joint breaker assembly configured to couple and uncouple drill string pipe sections for the various types of drill strings required for these various drilling techniques. A preferred drilling system also incorporates a triple-walled, reverse-circulation, down-the-hole hammer drill string and provides the necessary infeed and outfeed for lubricating mud, pressurized operating air, and sample-carrying return air flows.

The drilling system of this invention comprises a mobile drilling machine 10 (sometimes also called a "drill rig") comprising a drill mast assembly 12 mounted to a turntable 14 carried by an undercarriage 16. The undercarriage 16 may be any suitable carrier such as a wheeled vehicle, a track vehicle, or a sled vehicle. The drill mast assembly 12 comprises a drill head frame subassembly 18 and a mast support frame subassembly 20 that mounts frame subassembly 18. A mast trunnion and slide frame 22 assembly slideably carries drill mast 12 and mounts drill mast 12 to the turntable 14.

In point of reference, in the following description, "upper", refers to elevated aspects of the drill mast when the mast is upright, "bottom" refers to the opposite of upper, "outer" refers to outward away from the turntable, and "inner" refers to inward facing toward the turntable.

Drill mast frame subassembly 14 comprises a pair of side beams 30, 32 connected across the top an upper cross beam 34 and connected across the bottom by a bottom cross beam 36. Outer and inner gusset plates 38 connect the upper ends of beams 30, 32 to the upper cross beam and stabilize the top of the drill mast frame subassembly 18. The bottom cross beam 36 is configured, viewed at right angels to the plane in which side beams 34 lay, as a wide angle "V" with the bottom apex of the "V" being provided with a rectangular passage in line with the mid-line drill string axis of the system. This bottom cross beam rectangular passage is provided by an enlarged rectangular box 40, open and the top and bottom and having a width greater that the width of the side beams 30, 32 and the bottom cross beam 35. Side beams 30, 32 are fabricated as steel box beams of generally square cross-section. Upper cross beam 34 is fabricated with welded steel side and top plates welded to the top portion of the side beams 30, 32; the ends of cross beam 34 being extended laterally outward beyond the side beams 30, 32. The bottom cross beam 36 is fabricated with welded steel side, top and bottom plate extended from the side beams to the box 40; and the box 40 is fabricated with welded steel plate side walls. The bottom cross beam plates are welded to the bottom portions of the side beams 30, 21 and to the box 40.

The side beams 30, 32 slideably mount a drill head assembly 50, the outer and inner faces of the side beams being provided with bearing surfaces on which the drill head assembly 50 bears when it travels up and down the drill mast assembly 12. The drill head assembly includes side bearing channels 52, 54 that have inner and outer bearing faces that engage the outer and inner faces of the side beams 30, 32 and ride thereon. Side bearing channels 52, 54 also have base faces, located at their base between their inner and outer faces, that slideably engage the opposed side faces of side beams 30, 32 to locate and stabilize the drill head assembly 50 between the two side beams.

The drill mast subassembly 18 also comprises a drill head positioning subassembly. The drill head assembly 50 tracks along the side beams 30, 32 and is moved therealong by means of left and right side cable and hydraulic cylinder positioners. The left side cable and cylinder positioner comprises: (a) a left hand hydraulic cylinder 56 mounted to and suspended from the left extension of the upper cross beam 34 at its cylinder end along the left side of the side beam 30; (b) a cable sheave subassembly 60 mounted at the end of the cylinder rod associated with cylinder 56 and carrying a pair of freely rotatable cable sheaves; (c) an upper cable sheave 64 freely rotatably mounted in the left extension of the upper cross beam 34; (d) a bottom cable sheave 68 free rotatably mounted at the bottom of side beam 30; (e) a cable tensioner drum 72 mounted on the left side at the bottom of side beam 30; (f) a left side upper cable dead end tensioner and shock adjuster 76; (e) a left side drill head assembly bottom positioning cable 80 that extends upward from the tensioner drum 72 and reeves around the lower sheave of the subassembly 60, extends downward and reeves around sheave 68, and extends upward to a point of connection 86 with the drill head assembly 50; and (g) a left side drill head assembly upper positioning cable 88 that extends from the cable shock adjuster 76 downward and reeves around the upper sheave of the subassembly 60, extends upward and reeves around upper sheave 64, and extends downward to a point of connection 92 with the drill head assembly 50. The right side cable and cylinder positioner comprises: (a) a right hand hydraulic cylinder 58 mounted to and suspended from the right extension of the upper cross beam 34 at its cylinder end along the right side of the side beam 32; (b) a cable sheave subassembly 62 mounted at the end of the cylinder rod associated with cylinder 58 and carrying a pair of freely rotatable cable sheaves; (c) an upper cable sheave 66 freely rotatably mounted in the right extension of the upper cross beam 34; (d) a bottom cable sheave 70 freely rotatably mounted at the bottom of side beam 32; (e) a cable tensioner drum 74 mounted on the right side at the bottom of side beam 32; (f) a right side upper cable dead end tensioner and shock adjuster 78; (e) a right side drill head assembly bottom positioning cable 82 that extends upward from the tensioner drum 74 and reeves around the lower sheave of the subassembly 62, extends downward and reeves around sheave 70, and extends upward to a point of connection 88 with the drill head assembly 50; and (g) a right side drill head assembly upper positioning cable 90 that extends from the cable shock adjuster 78 downward and reeves around the upper sheave of the subassembly 62, extends upward and reeves around upper sheave 66, and extends downward to a point of connection 94 with the drill head assembly 50. The left side cylinder 56 is stabilized by cylinder mounting bracket 96 extending from side beams 30. The right side cylinder 58 is stabilized by cylinder mounting bracket 98 extending from side beam 32. Over the length of extension of the rods of cylinders 56 and 58, outer and inner, left and right rod aligning tracks 100, 102 and 104, 106, respectively, are provided on the outer and inner faces of the side beams 30, 32 to carry and stabilize the end of these cylinder rods. The support and stabilization is provided by the respective left and right cable sheave subassemblies 60, 62 which journal mount outer and inner guide wheels 108,110 (left side) and 112, 114 (right side) which track on the side beam aligning tracks. In the operation of the drill head positioning subassembly, extension of the rods of cylinders 56, 58 will cause the drill head assembly 50 to move up the drill mast side beams 30, 32, and retraction of the cylinder rods will cause the drill head assembly 50 to move down the drill mast side beams 30, 32.

The drill mast frame subassembly 18 is carried and reinforced by the mast support frame subassembly 20. Mast support frame subassembly 20 comprises a pair of side beams 120, 122, each of which being parallel and underlying one of the drill mast frame subassembly side beams 30, 32. Left and right side beams 120, 122 are shorter than their corresponding drill mast frame side beams 30 or 32, and are connected thereto by upwardly-angled left and right upper end beams 124, 126 and downwardly-angled left and right lower end beams 128, 130. The upper and lower end beams, 124, 126 and 128, 130, are long enough to space the side beams 120, 122 inward from the drill mast frame side beams 30, 32 a sufficient distance to provide adequate clearance therebetween for travel of drill head assembly 50 and the related apparatus, piping and hosing. Left and right brace beams 132, 134 extend between the mast frame and support frame side beams near the top of the drill mast assembly 12 to form a triangular reinforcing brace with the upper end beams 124, 126. The beams that make up the mast support frame subassembly 20 are steel box beams welded to one another and to the corresponding outer drill head frame side beams.

The mast trunnion and slide assembly 22 comprises a mast slide subassembly 140 to which the drill mast assembly 12 is slideably mounted, and turntable slide subassembly 142 to which the mast slide assembly is pivotally mounted. The turntable slide subassembly 142 is carried by the turntable 14. The mast slide subassembly 140 operates left and right pairs of upper and lower steel bearing sleeves 144, 146 and 148, 150 that slideably enclose and ride on the mast support frame side beams 120, 122. Upper and lower steel cross beams 152, 154 are welded to the opposed faces of the upper and lower bearing sleeve pairs 144, 146 and 148, 150. A steel trunnion-mounting framework 156 is mounted to the cross beams 152, 154 for a steel mast pivot pin 158. Pivot pin 158 is positioned in the trunnion-mounting framework 156 from the inward side and is confined therein by an appropriate bearing collar 160 mounted to the outer end of pivot pin 158. The inward end of the pivot pin 158 is rotatably mounted in a male trunnion framework 162 so that framework 162 is located adjacent to and inward of the trunnion-mounting framework 156. Male trunnion framework 162 pivots about pivot pin 158 in a plane parallel to whatever position the drill mast assembly 12 assumes. Male trunnion framework 162 is provided with left and right mast pivoting cylinder rod mounting lugs 164, 166. A steel mast pivoting cylinder bracket 168 is welded to the inward side of the lower bearing sleeves 148, 150 and pivotally mounts a pivot cylinder 170. The end of the rod associated with cylinder 170 is attached to one or the other of the rod mounting lugs 164, 166. When cylinder 170 is actuated, the drill mast assembly 12 will pivot about the axis of pivot pin 158. The upper and lower cross beams 152, 154 mount left and right mast extension cylinders 172, 174. The ends of the rods associated with cylinders 172, 174 are connected to the upper end of the drill mast frame subassembly 18 by left and right steel mounting arms 176, 178 which are welded to the cross beam 34. When the cylinders 172, 174 are actuated, the drill mast assembly 12 will slide up or down, through the bearing sleeves 144, 146 and 148, 150.

The turntable slide subassembly 142 comprises a pair of telescoping mast extender tubes 190, 192 mounted on the deck 194 of the turntable 14, and a pair of tilting cylinders 196, 198 mounted to a slide mounting 200. The outer ends of the telescoping mast extender tubes 190, 192 are connected to left and right mounting lugs 202, 204 provided on the male trunnion framework 162. The ends of the rods associated with the tilting cylinders 196, 198 are connected to left and right mounting lugs 206, 208. When the mast extender tubes 190, 192 are actuated, the drill mast assembly 12 will be shifted inward or outward with respect to the turntable. When the tilting cylinders 196, 198 are actuated, the drill mast assembly 12 will be tilted relative to the axis of the turntable 14. If the turntable axis is considered to be the X axis of the system, tilting cylinders 196, 198 will tilt the drill mast assembly 12 about the Y axis of the system and pivot cylinder 170 will pivot the drill mast assembly 12 about the Z axis of the system. The Y axis of the system is defined by the axis point 210 through the left and right mounting lugs 202, 204. The so-called "Z axis" of the system, defined by the axis of the pivot pin 158, does not remain perpendicular to the turntable axis, although it does remain perpendicular to the Y axis of the system.

Figure 5:
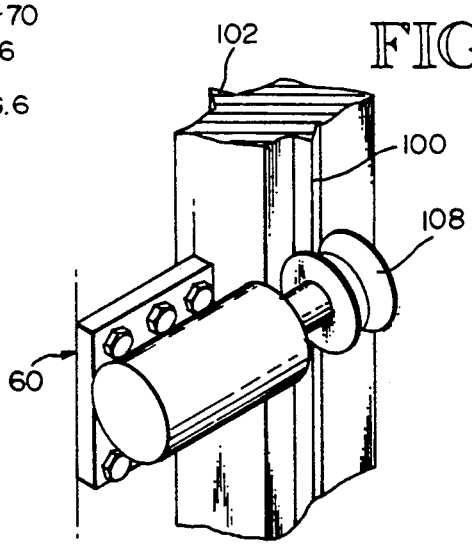
FIG. 5 is an enlarged detail view of a portion of the FIG. 4 view illustrating the stabilizer mounting for the drill head positioning cylinder rod.
Figure 7:
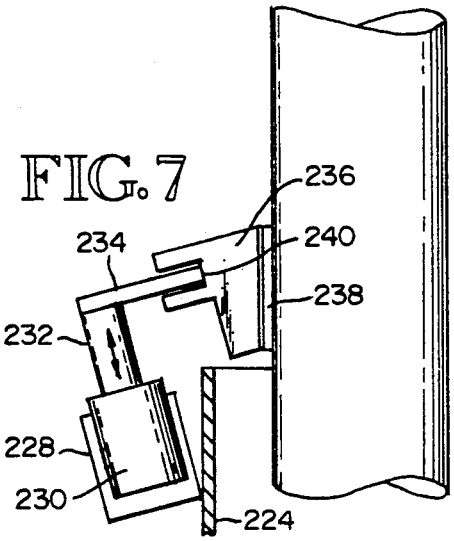
FIG. 7 is a side elevation view further illustrating the workings of the structure shown in the FIG. 6 detail view.
Figure 8:
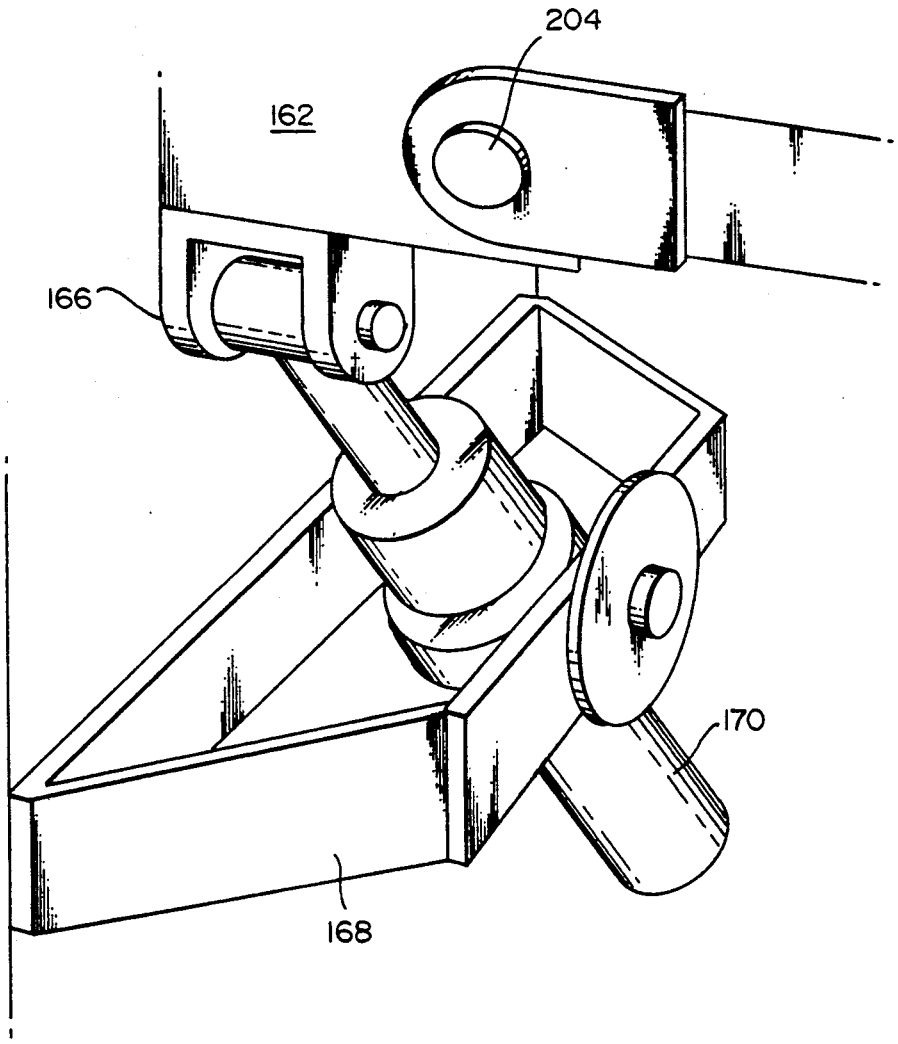
FIG. 8 is a perspective view of the drill mast pivot cylinder mounting.
Figure 9:
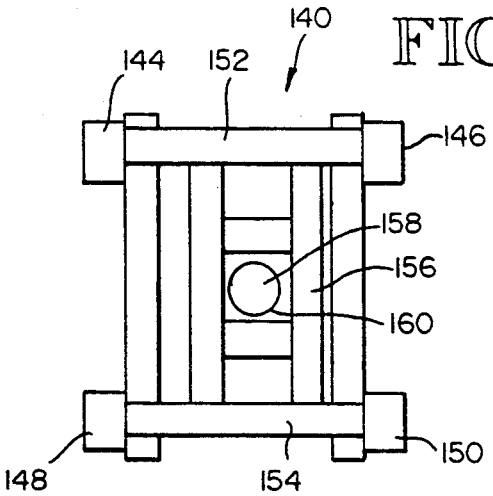
FIG. 9 is a plan view of the drill mast slide assembly.
Figure 11:
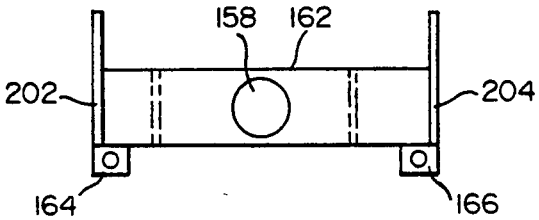
FIG. 11 is a plan view of the male trunnion that underlies the FIG. 9 assembly.
Figure 10:
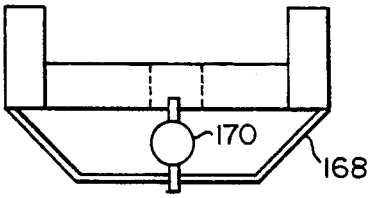
FIG. 10 is an end view of the FIG. 9 assembly.
Figure 12:
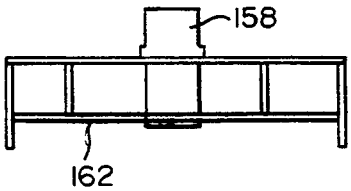
FIG. 12 is an end view of the FIG. 11 trunnion.
Figure 13:
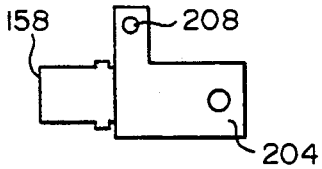
FIG. 13 is a side view of the FIG. 11 trunnion.
Figure 14:
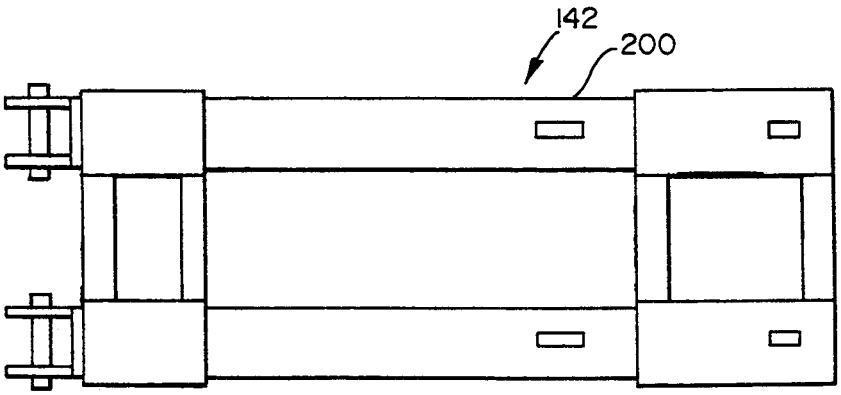
FIG. 14 is a plan view of the mast turntable slide assembly.
Figure 15:
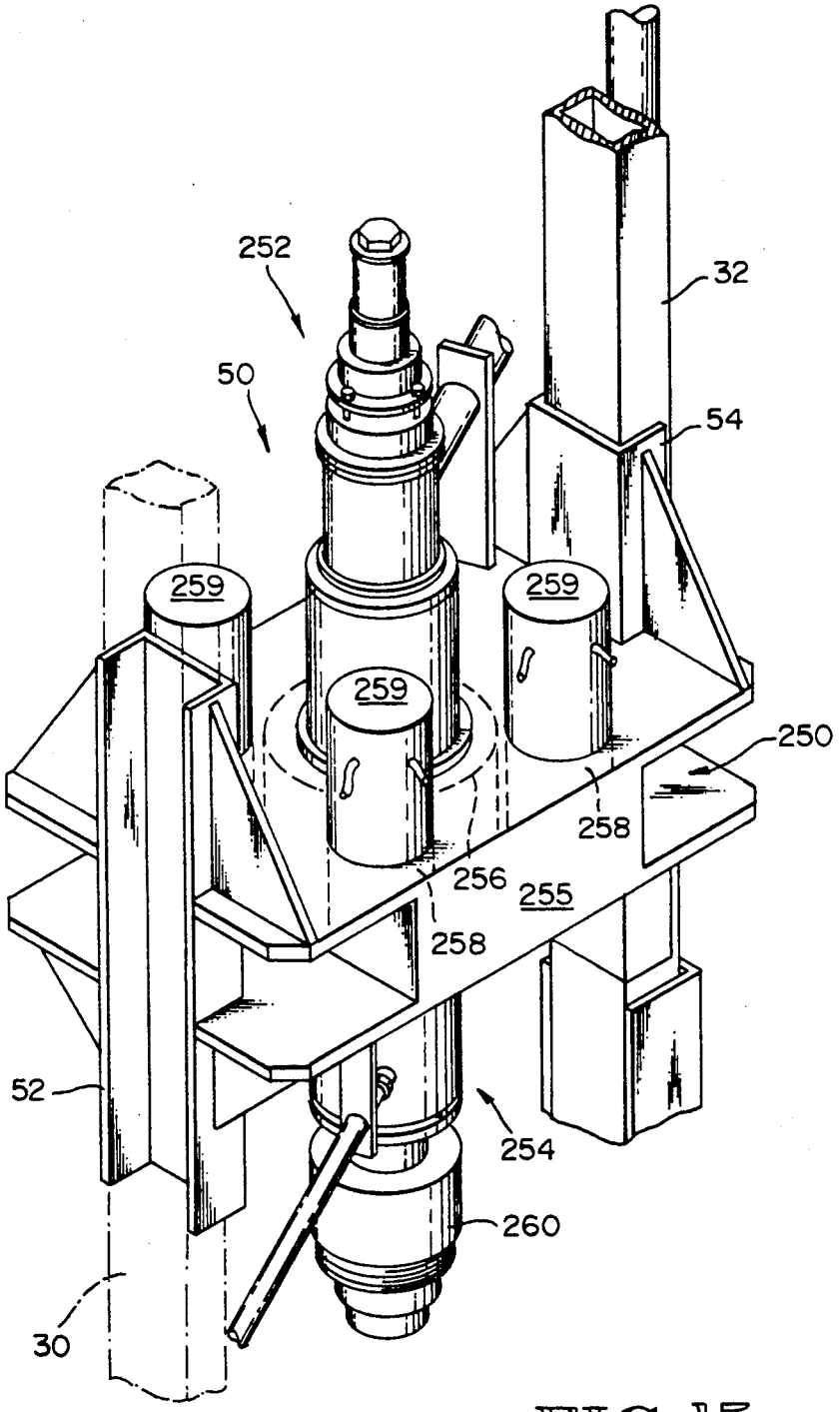
FIG. 15 is a perspective view of the drill head assembly.
Figures 16, 17, 18:
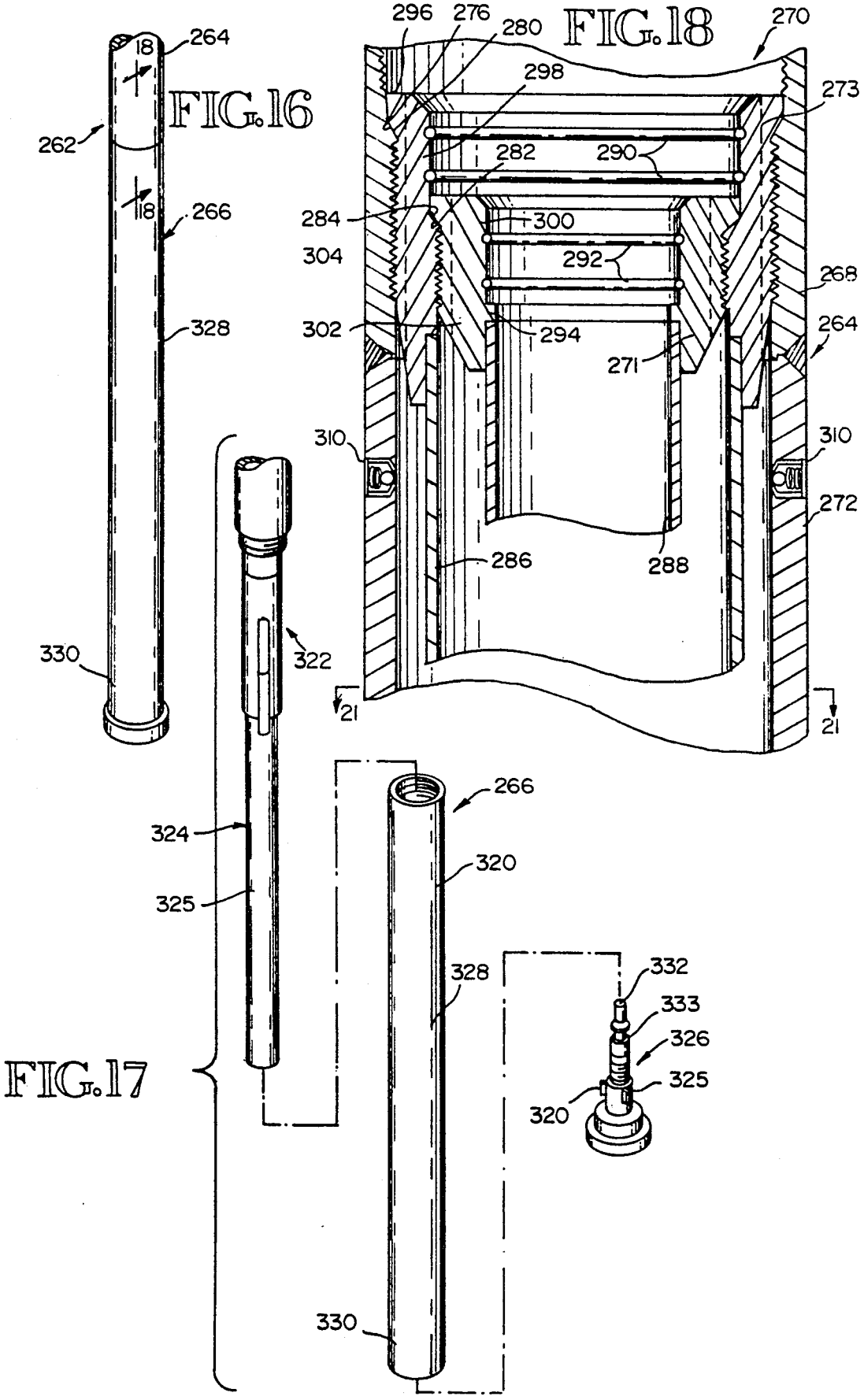
FIG. 16 is a view of an unasssembled triple-walled drill bit section.
FIG. 17 is an exploded view of the FIG. 16 drill bit section.
FIG. 18 is a cross-section view of the drill bit section coupling to the next-adjacent drill string stem section.
Figure 19:
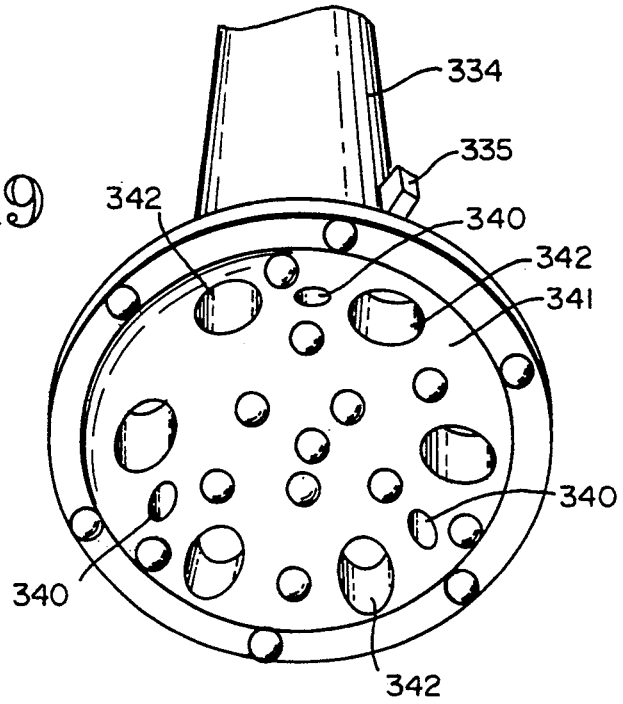
FIG. 19 is a bottom perspective view of an exemplary drill bit head of FIG. 16.
Figure 20:
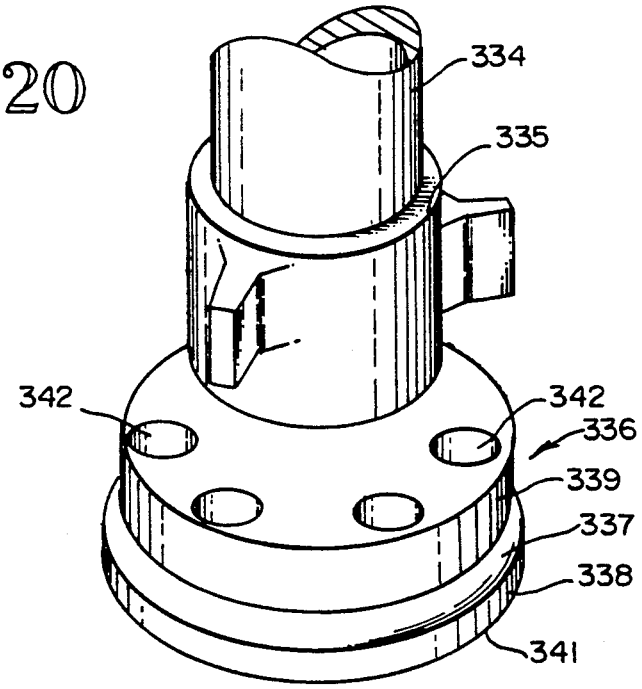
FIG. 20 is a side perspective view of the FIG. 19 drill bit.
Figure 21:
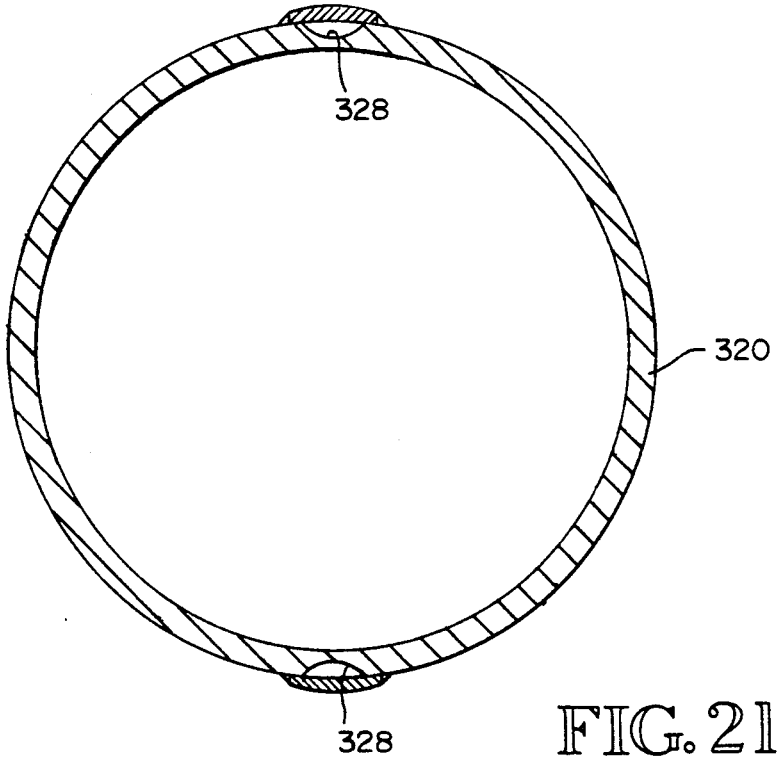
FIG. 21 is a cross section an exemplary outer spacing for use with the FIG. 16 drill bit section.
Figure 22:
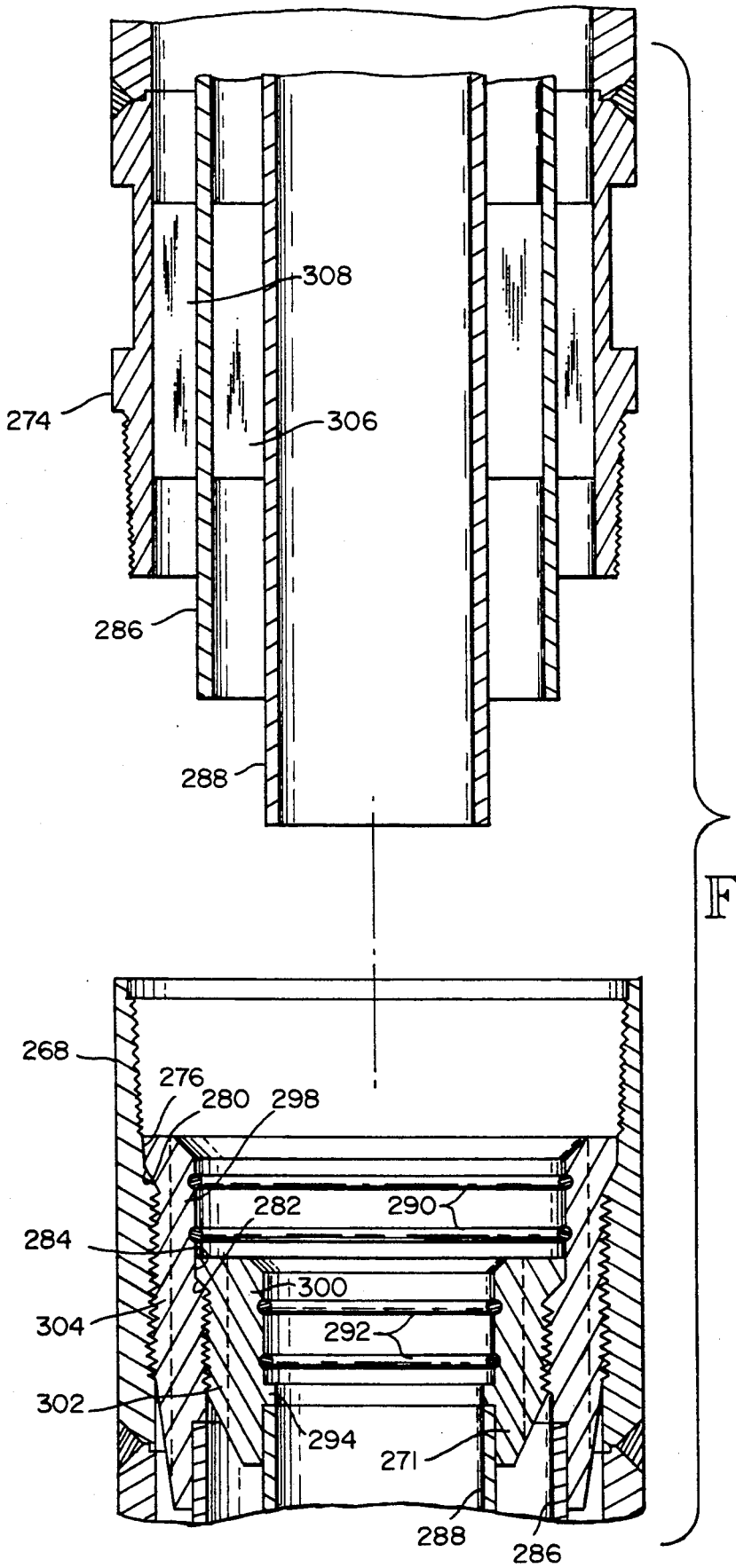
FIG. 22 is an exploded view of the FIG. 18 coupling.

A pipe joint breaker assembly 220 is associated with the drill mast assembly 12. Assembly 220 is supported from a steel support platform 222 welded to the outer face of the drill mast frame bottom cross beam 34 just above box 40. Assembly 220 is centered over the passage 41 through box 40 and mounted on the frame 222. Assembly 220 comprises a steel cylinder 224 positioned in axial alignment with the passage through box 40 and having an inner diameter at least as large as the width of passage 41. A series of steel angle brackets 226 are welded to the periphery of cylinder 224 at their apexes so that a series of steel hydraulic cylinder-holding cups 228 may be mounted between the bracket legs as shown in FIG. 5. Each cylinder-holding cup 228 is aligned at an acute angle of about 10 degrees outward from the axis of cylinder 224 (which is coincident with the drill string axis of the system) and welded to the adjacent legs of the angle brackets 226. There are at least three cups 228 located around the periphery of cylinder 224. At least three hydraulic cylinders 230 are mounted in three of the cups 228 with their cylinder rods extending upward and outward at the acute angle of the cups 228. Each cylinder rod 232 has an arm in the form of a steel bar 234 extended at right angle to the cylinder axis. A removable gripper shoe 236 is carried by each bar 234. Each gripper shoe 236 has a curved gripper face 238 aligned parallel to the drill sting axis. With at least three such gripper shoes installed about the periphery of cylinder 224, when the gripping cylinder rods 232 are retracted, the shoe gripper faces 238 will be translated downward and inward toward the drill string axis. Any drill string section, such as a coupling or bit, can be grasped by the gripper shoe faces and secured relative to the cylinder 224. By so doing, and then rotating the drill string in opposite hand to the threads of the drill string section connections, the drill string above the gripper shoes 236 can be unthreaded from the drill string section confined by the gripper shoes. Each gripper shoe 236 is provided with an outward-opening slot 240 designed to fit over the end of the adjacent gripper cylinder rod arm 234. When a gripper cylinder rod 232 is extended, bringing the associated gripper shoe out of contact with the drill string, the shoe may be pivoted away from the drill string and removed from the cylinder rod arm. Thus, the shoe is interchangeable with shoes having different gripping faces 238 or with shoes having a different width to accommodate drill string sections of various diameters.

The drill head assembly 50 comprises a drive subassembly 250, a rotary air interchange and discharge subassembly 252, and a rotary lubricating mud interchange subassembly 254. The drive subassembly 250 comprises a drive gear box 255 to which the side bearing channels 52, 54 are mounted, an axial bull gear 256 and four peripheral drive pinion gears 258 meshed with the bull gear. The pinion gears are selectively driven by individual hydraulic motors 259 mounted atop the drive gear box 255. The rotary air interchange and discharge subassembly 252 comprises a concentric configuration of air inlet and discharge swivels that enable sample-containing return air to be withdrawn axially from the drill string and pressurized operating air to be directed into an annular passage in the drill string. The subassembly 252 is mounted axially atop the drive gear box 255 and is connected to appropriate supply and return air conduits. The lubricating mud interchange subassembly 254 comprises a concentric configuration of a mud inlet swivel enabling the introduction of lubricating mud to an annular passage in the drill string while enabling supply and return air to travel therethrough. The subassembly 254 is mounted axially underneath the drive gear box 255.

A drill head adapter 260 is bolted to the underside of the lubricating mud interchange subassembly 254 and constitute the first section of the drill string assembly 262. A preferred reverse-circulation drill string assembly is shown comprising a plurality of sections that are threaded to one another commencing with the drill head adapter 260, a plurality of intermediate pipe sections 264, and concluding with a drill bit section 266. The intermediate pipe sections 264 each comprise three concentric steel pipes joined together within an steel upper coupling sleeve 268 by a spider coupler 270. The upper coupling sleeve 268 has a configuration similar to a conventional box coupling of a box and pin threaded coupling employed in conventional drill string couplings in that the upper end of the coupling sleeve 268 has a tapered inwardly-threaded box end designed to have an correspondingly-tapered male thread pin end of an adjacent drill string section threaded therein. The upper end of the outermost pipe 272 (the section casing) is welded to the end of the coupling sleeve 268 opposite the threaded box end. The lower end of the casing pipe 272 is welded to a steel lower coupling sleeve 274. The lower coupling sleeve 274 has a configuration similar to a conventional pin coupling of a box and pin threaded coupling in that its lower end, opposite to the weldment to the casing 272, has an externally-threaded pin end.

The spider coupler 270 is located below the box end of the upper coupling sleeve 268 and comprises concentric inner and outer cylindrical elements 271 and 273. Coupling sleeve 268 has an inner conical surface 276 that makes a transition from the box end to a thicker main portion 278. It is within this main portion 278 that spider coupler 279 is positioned. If the outer element 273 of spider coupler 279 is provided with an externally-threaded portion, the main sleeve portion 278 can be internally-threaded as shown to receive and locate the spider coupler. The spider coupler must be positively positioned within sleeve 268 and, to that end, the outer element 273 may be provided with an outer conical surface 280 designed to seat against the upper coupling sleeve conical surface 276. The inner element 271 of the spider coupler 270 must be positively positioned within the outer element 273 and, to that end, the inner element may be provided with an outer conical surface 282 designed to seat against an inner conical surface 284 provided in the outer element 273. The outer element 273 is counterbored to receive the upper end of an intermediate pipe 286, pipe 286 being welded to the lower end of the outer element. The inner element 271 is counterbored to receive the upper end of an inner pipe 288, pipe 288 being welded to the lower end of the inner element. The interiors of the inner and outer elements are provided with O-ring seal sets 290, 292. The seal set 290 in the outer element 273 is located above the position of the inner element 271. The seal set 292 in the inner element 271 is located above the position of the upper end of the inner pipe 288, being separated therefrom by an inner rim 294.

The pin ends of the concentric intermediate and inner pipes 286, 288 extend beyond the pipe section lower coupling sleeve 274. The intermediate pipe 286 must extend beyond the lower coupling far enough to be insertable into the adjacent outer spider element 273 into engagement with the O-ring seal set 290. The inner pipe 288 must extend beyond far enough beyond the lower coupling to be insertable into the adjacent inner spider element 271 into engagement with the O-ring seal set 292. When adjacent pin and box ends are threaded together, the bottom of the upper intermediate pipe 286 will extend into the box end coupling below and seat on the upper rim 296 of outer element 273, and the bottom of the upper inner pipe 288 will extend further into the box end coupling below and seat on the inner rim 294 of inner element 271. The tolerances between the intermediate and inner pipe ends and the pipe-receiving portions 298, 300 of the adjacent spider inner and outer elements are small enough to insure that the O-ring seal sets will make pressure-tight seals.

The lower ends of the intermediate and inner pipes in a pipe section are supported within the lower coupling sleeve by means of spacers. These spacers 306, 308 are welded to the outer periphery of the inner and intermediate pipes, respectively, and located within the confines of the lower coupling sleeve 274. The spacers contact the opposing surface across the annular space to maintain the concentric relationship of the three pipes. Consequently, the inner and intermediate pipe lower ends project unencumbered beyond the lower coupling sleeve but are fixed concentrically by the spacers. Because the spacers are attached to one surface within the annulus, the inner and intermediate pipes may contact and expand relative to the outer casing without damaging any of the interconnections between the pipes that make up a pipe section of the drill string.

The threaded peripheral surfaces of the inner and outer spider elements 271, 273 are provided with a series of longitudinal grooves 302, 304 radially spaced around the exterior of the inner and outer elements. These grooves are similar in appearance to spline grooves and provide for fluid communication longitudinally through the pipe section couplings: that is, through the annular passage between the outer casing and the intermediate pipes and through the annular passage between the intermediate pipes and the inner pipes through the pipe couplings.

If one of the inner or intermediate or outermost pipes is damaged or worn out, the spider may be disassembled and a replacement made. Consequently, a pipe section may be repaired rather than completely replaced. Oftentimes, it will be an outermost pipe, or casing, that will become damaged or worn out and require replacement. It that event, the spider may be removed from the upper coupling sleeve, with the intermediate and inner pipes attached, and simply reinserted as a complete unit into a replacement upper coupling and casing.

In a typical use of this triple-walled drill string, pressurized air would be delivered downward through annulus between the longitudinally-assembled inner and intermediate pipes, return air carrying drilled particle samples would be delivered upward through the longitudinally-assembled inner pipes, and lubricating mud would be delivered downward through the annulus between the longitudinally-assembled outer casings. The outer casing of each pipe section is provided with outlet passages 310 from the annular passage between the outer casing and the intermediate pipe. These outlet passages enable lubricating mud to vent to the outer periphery of the drill string along the pipe sections during a drilling operation. These outlet passages are preferably provided at several locations radially around the casing and may be provided in the upper coupling sleeve at the box end of each pipe section.

In the preferred embodiment of the triple-walled drill string, the bottom section, comprising the drill bit section 266, comprises an outer casing section 320, an interchanger subassembly 322, a down-the-hole hammer drive subassembly 324, and a bit subassembly 326. The bottom casing section 320 comprises a threaded box coupling as previously described at its upper end and a casing pipe welded to the box coupling and extending down into contact with the drive subassembly 326. The interchanger subassembly 322 comprises a double-walled cross-over upper section adapted to be connected to and supported by the bottom casing box coupling. The cross-over section is ported to receive pressurized air from above and transfer it into the down-the-hole hammer subassembly 324 for operating the hammer subassembly and for supplying scavenging air to the bit head. The upper portion of the interchanger subassembly 322, contained within the bottom casing box, is provided with an external peripheral O-ring seal which bears against the inner periphery of the coupling as a mud seal. The bottom box coupling is provided with lubricating mud passages, as described above, located above the O-ring seal and, consequently, lubricating mud flow will be blocked by the O-ring seal and forced to pass out through the adjacent lubricating mud passages. The bottom casing pipe section is provided with external, longitudinal grooves 328 extending from the upper lubricating mud passages to a region adjacent the drive subassembly 326. At least two such grooves, 180 degrees apart, are preferably provided. These grooves 328 are in fluid communication with the upper lubricating mud passages and with lower lubricating mud passages 330 so that lubricating mud can be channeled to the bottom of the drill string for lubricating the outer casing at points adjacent the drive subassembly 326. This feature of the invention eliminates the need for providing for lubricating mud passage through the interchanger subassembly 322.

A preferred bit subassembly 326 for placer drilling comprises a scavenging air inlet 332, hammer piston striking face 333, bit shank 334, centering spider 335, and the head 336. The head 336 contains a pre-load surface 337 against which the bottom end of bottom casing pipe 320 abuts. Centering spider 335 contacts the inner wall of drive hammer subassembly casing 325 and insures that head 336 is axially centered at the end of the drill string. The pre-load surface 337 makes the transition between the bore-contacting periphery 338 of the bit head and a collar 339. The bit is mounted within the bottom end of the drive hammer casing 325 so that the end of casing 325 abuts the top of the collar 339. A portion of collar 339 remains within the casing pipe 320 at all time during a drilling operation by the working area limits on the bit shank so that the upper parts of the bit subassembly are isolated from the bore hole. Consequently, no lubricating mud or other contaminants can gain access to the inner portions of the bit subassembly from the periphery of the bit. Therefore, the entrained sample cuttings will provide a true sample of the geological structure through which the bore hole was made.

A preferred bit head 336 is provided with internal scavenging air passages 340 leading from the interior part of the bit subassembly, that is in air communication with the drive hammer subassembly, to the bottom cutting face 341 of the bit head for flushing the face of the bit head and entrained sample cuttings from the bottom of the bore hole. The bit head 336 is also provided with internal return air passages 342 leading from the cutting face 342 through the bit head 336 to open into the annulus between the hammer subassembly casing 325 drill string bottom casing pipe 320 for transfer of the entrained sample cuttings away from the drill bit head. These entrained cuttings travel upward along the exterior of the hammer subassembly casing 325, and inside of the drill string bottom section casing 320, and pass into the cross-over of the interchanger subassembly 322. From within the cross-over, the entrained sample cuttings travel axially upward through the inner pipes 288 of the drill string sections and finally through the drill head assembly 50 and out into a collecting tank where the entraining air and the sample cuttings are separated. The bit head 336 is designed so that sample cuttings must pass upward through the bit head into the annulus between the bottom section casing 320 and the exterior of the drive hammer subassembly casing 325. The sliding fit between the upper part of the collar 339 ensures that no contaminating material from the bore hole can gain access to the entraining air stream as it carries sample cuttings upward for collection.

Figure 2:
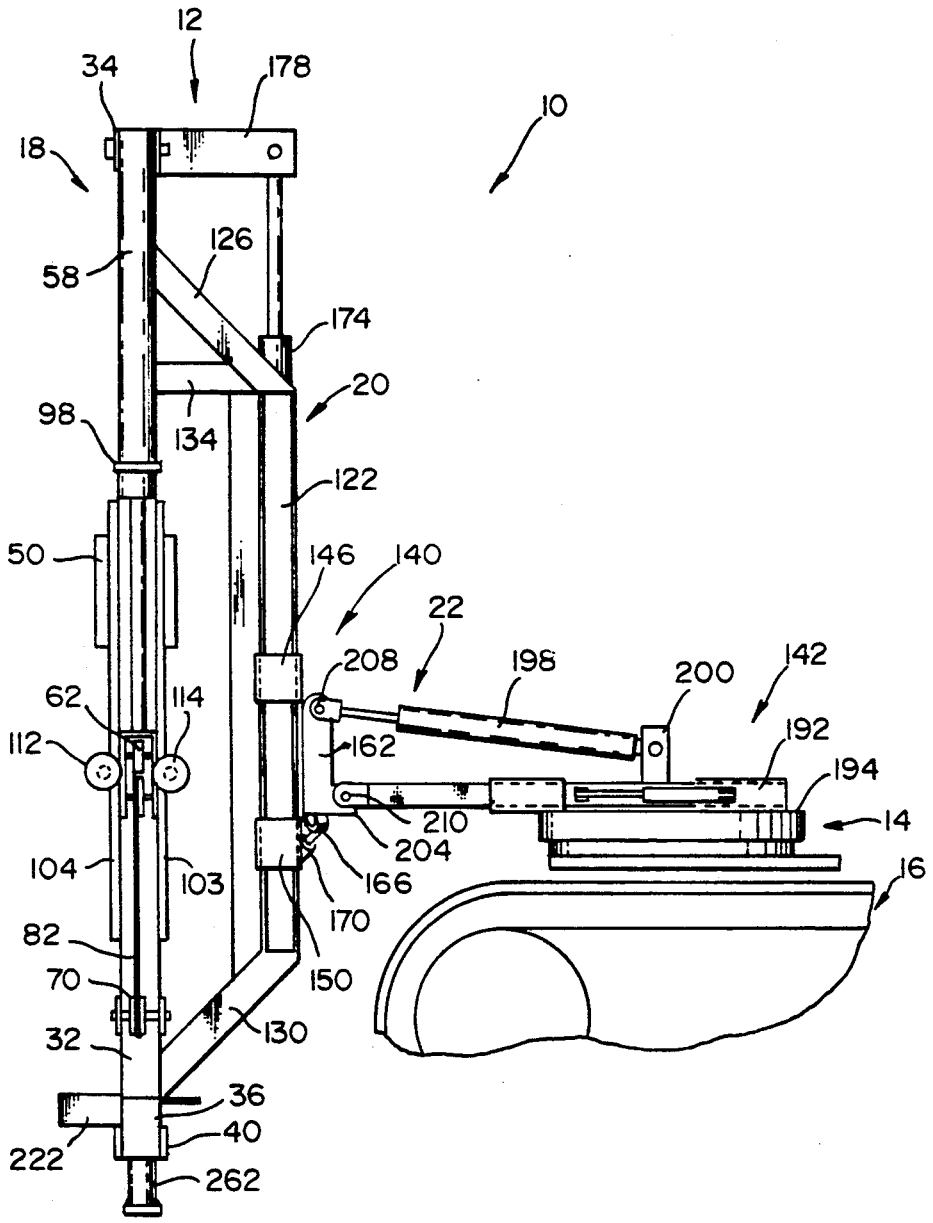
FIG. 2 is a side elevation view of the drill mast mounted to its turntable and positioned vertically.

The preferred embodiment of this system is capable of drilling to 3000 feet, has a drill head torque of 20,000 ft-lbs. and a draw works lifting power of 88,000 lbs. The drill mast turntable can be mounted on truck (FIG. 1), track frame (FIG. 2) or other types of carriers. The mast will turn 90 degrees-to-carrier on both sides and, with the mast trunnion and slide assembly, will allow positioning to all positions at side or rear of carrier. The drill mast transports laying down over the turn table. With the hydraulic mast extension and the telescoping extension on the turn table, any angle hole can be drilled without a drill pad. No drill pad is needed with this system. A three-way operator's control console may be mounted to the mast if desired. The drill head with gear reduction can be set up with two to eight high performance hydraulic motors for varied applications and with a variable speed rotation control located on the operator's console. For example, up to four additional motors could be mounted to the underside of the drill head gear box 255 to drive the pinion gears to provide added torque up to 35,000–40,000 ft-lbs. In addition, a speed increaser gear box could also be mounted to the underside of the gear box 255, there being sufficient power to drive the drill string through the speed increaser. Thus, with the present system, a drilling setup requiring only 30 rpm drilling speed could be easily converted to a setup requiring a 600 rpm drilling speed.

Figure 3:
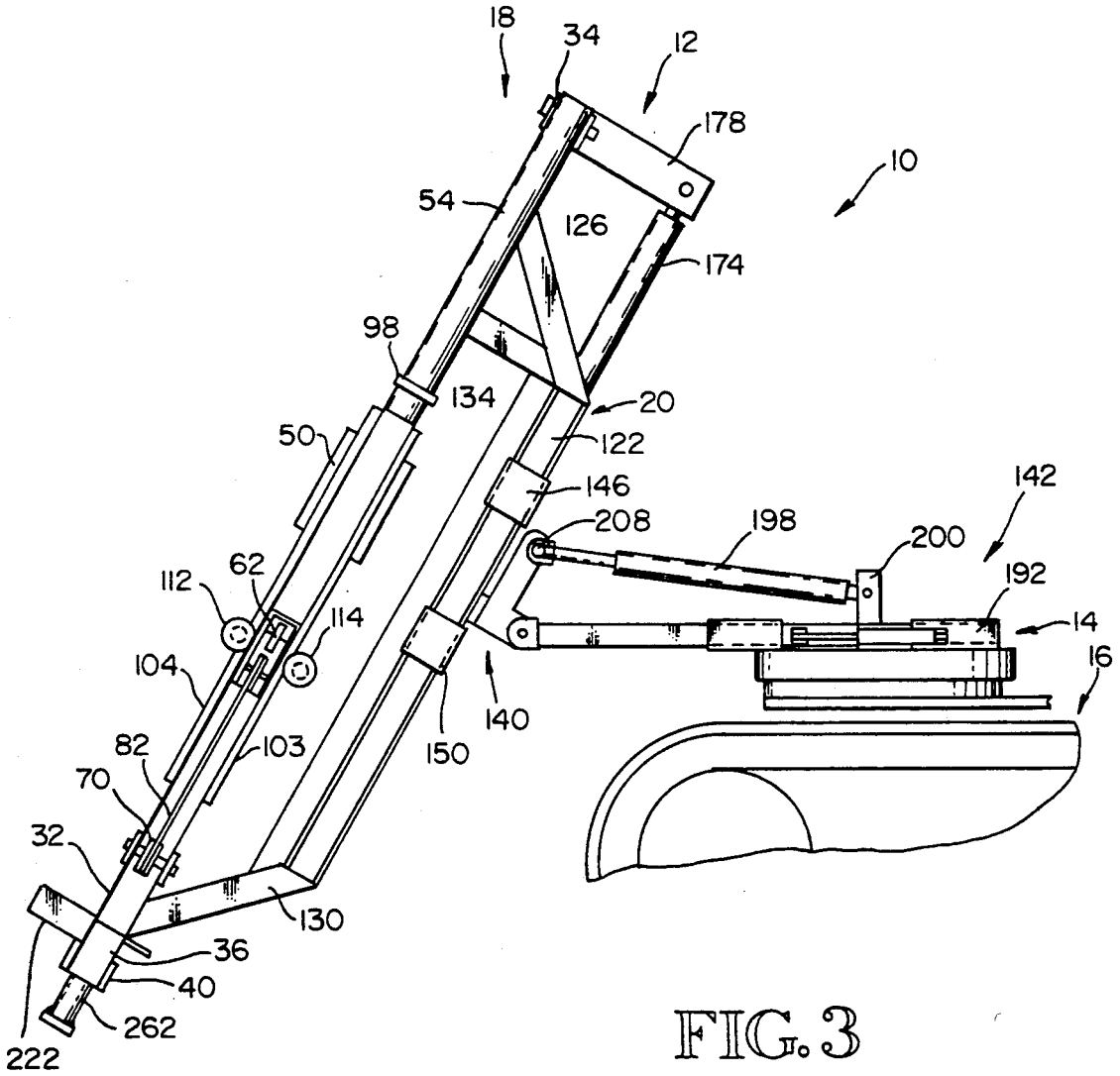
FIG. 3 is another side elevation view of the drill mast mounted to its turntable and tilted with respect to the plane of the turntable.
Figure 4:
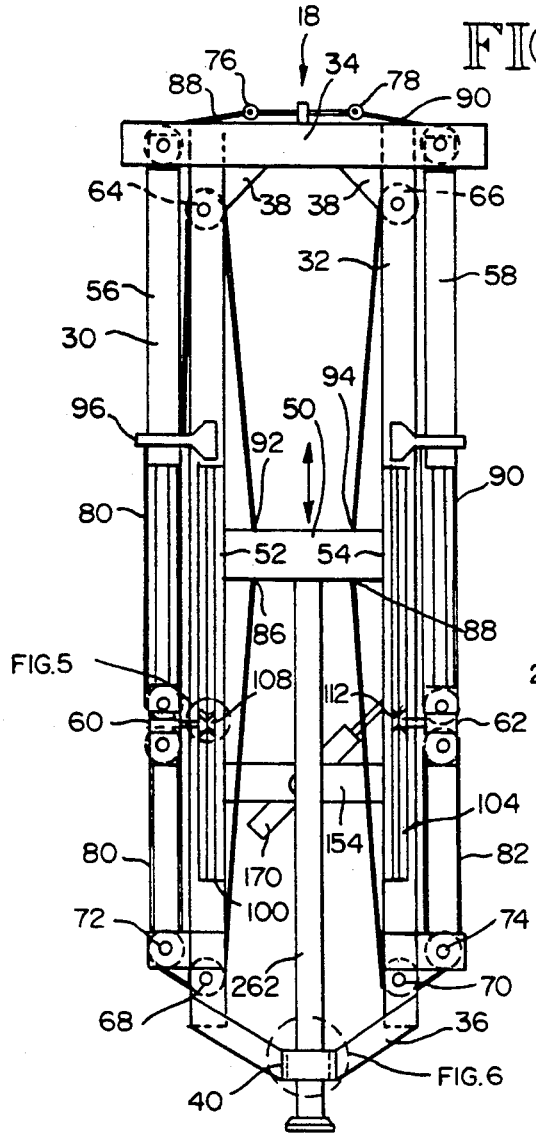
FIG. 4 is a front elevation view of the drill mast.
Figure 6:
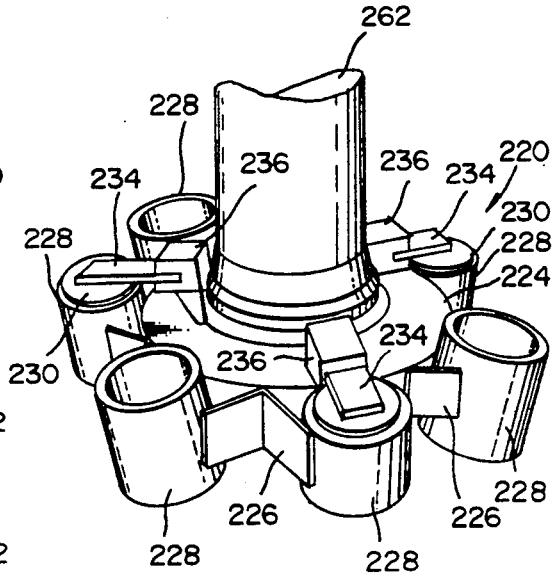
FIG. 6 is an enlarged detail view of another portion of the FIG. 4 view illustrating the pipe joint breaker assembly.

In the course of operation, the drilling rig of this invention would be transported to a drilling site and roughly positioned at the desired point of drilling. Through appropriate rotation of the turntable and inner/outer positioned of the mast-turntable extension, the drilling mast can be directed to the exact location required. It may be the case that the drilling mast must be angled to become properly directed and, in such a case, the mast trunnion can rotate the mast to the desired shewed position, and the mast extension can pivot the drilling mast from the FIG. 2 position to a FIG. 3-like position so that the drilling mast can thereby be positioned in like manner to that shown in FIG. 1, to a variety of compound-angled positions however conditions require. Thus, the drilling mast can be shifted in and out, pivoted from vertical, and skewed to a compound angle, all without moving the carrier. When the mast is properly located at the point of desired drilling, the mast in then shifted down into contact with the ground for the commencement of drilling.

Depending on surface conditions, the bottom of the drilling mast may be positioned to bear against a timber or other support to stabilize its locations with respect to the drilling hole's surface entry. An inner bearing plate 37 is provided at the bottom of the drill mast frame side beams 30,32 for this purpose. This would be useful when time comes for pulling the drilling string from the bore hole.

While the preferred embodiment of the invention has been described herein, variations in the design may be made. The scope of the invention, therefore, is to be limited by the claims appended hereto.

The embodiments of the invention in which an exclusive property is claimed are defined as follows:

1. An exploration mineral sample drill string adapted for reverse-circulation sample drilling composed of multi-walled pipe sections coupled in series to one another; each pipe section including an outer casing, an upper coupling welded to the upper end of said outer casing, a removable spider coupling means mounted within said coupling, and inner and intermediate pipes having upper ends concentrically-mounted by said spider coupling means within said outer casing; said spider coupling means being adapted to receive the bottom ends of inner and intermediate pipes from an upper, adjacent pipe section whereby said spider coupling means concentrically positions the bottom ends of the adjacent pipe section inner and intermediate pipes; the pipe sections being coupled together in pin-and-box connections, the box connection comprising said upper coupling and the pin connection comprising a lower coupling with the inner and outer pipes extending beyond the pin end of said lower coupling by lengths sufficient to be inserted into an adjacent upper coupling and interfit with the spider coupling means therein, when the pin-and-box connection is completed, whereby the passages formed by said inner and intermediate pipes in adjacent pipe sections are joined fluid-tightly within said spider coupling means when the pin-and-box connections is completed; said spider coupling means and said upper coupling of each pipe section being so constructed and arranged that said spider coupling means is mounted within said upper coupling below the box end of said upper coupling whereby the space occupied by the pin end of an adjacent pipe section lower coupling is unoccupied by said spider coupling means.

2. The drill string according to claim 1 wherein said spider coupling means is provided as two concentric elements, the inner element seating within the outer element with the upper end of the inner plate being secured to the inner element and with the upper end of the intermediate pipe being secured to the outer element, whereby concentric fluid passages are provided between the outer casing and the intermediate pipe and between the intermediate pipe and the inner pipe.

3. The drill string according to claim 2 wherein said inner and outer elements are provided with longitudinal fluid passages along their outer surfaces whereby fluids may pass unrestrictedly through a pin-and-box connection from the concentric fluid passages above and below the pin-and-box connection.

4. An exploration mineral sample drill string adapted for reverse-circulation sample drilling composed of multi-walled pipe sections coupled in series to one another; each pipe section including an outer casing, an upper coupling welded to the upper end of said outer casing, a removable spider coupling means mounted within said coupling, and inner and intermediate pipes having upper ends concentrically-mounted by said spider coupling means within said outer casing; said spider coupling means being adapted to receive the bottom ends of inner and intermediate pipes from an upper, adjacent pipe section whereby said spider coupling means concentrically positions the bottom ends of the adjacent pipe section inner and intermediate pipes; said outer casing being provided with seep holes adjacent the upper coupling whereby drilling mud pass through the outer casing into the bore hole for lubrication.

5. The drill string according to claim 4 wherein the pipe sections are coupled together in pin-and-box connections, the box connection comprising said upper coupling and the pin connection comprising a lower coupling with the inner and outer pipes extending beyond the lower coupling by lengths sufficient to be inserted into an adjacent upper coupling and interfit with the spider coupling means therein, when the pin-and-box connection is completed, whereby the passages formed by said inner and intermediate pipes in adjacent pipe sections are joined fluid-tightly within said spider coupling means when the pin-and-box connections is completed.

6. The drill string according to claim 5 wherein said spider coupling means is provided as two concentric elements, the inner element seating within the outer element with the upper end of the inner pipe being secured to the inner element and with the upper end of the outer pipe being secured to the outer element, whereby concentric fluid passages are provided between the outer casing and the intermediate pipe and between the intermediate pipe and the inner pipe.

7. The drill string according to claim 6 wherein said inner and outer elements are provided with longitudinal fluid passages along their outer surfaces whereby fluids may pass unrestrictedly through a pin-and-box connection from the concentric fluid passages above and below the pin-and-box connection.

8. An exploration mineral sample drill string adapted for reverse-circulation sample drilling composed of multi-walled pipe sections coupled in series to one another; each pipe section including an outer casing, an upper coupling welded to the upper end of said outer casing, a removable spider coupling means mounted within said coupling, and inner and intermediate pipes having upper ends concentrically-mounted by said spider coupling means within said outer casing; said spider coupling means being adapted to receive the bottom ends of inner and intermediate pipes from an upper, adjacent pipe section whereby said spider coupling means concentrically positions the bottom ends of the adjacent pipe section inner and intermediate pipes; said drill string including a drill bit section provided as the bottom drill string section comprising an upper coupling; an outer casing welded to the bottom end of said upper coupling; an interchanger subassembly located axially within said outer casing, the upper end of said interchanger subassembly being adapted to receive the inner and intermediate pipes from the upper adjacent pipe section whereby entraining air and drilling mud may be transferred into said drill bit section and whereby mineral-entrained air from below may be transferred into the upper adjacent pipe section; a down-the-hole drive hammer connected axially in series with said interchanger subassembly; and a bit subassembly connected axially in series with said drive hammer; said interchanger subassembly being provided with inlet air passages for transfer of air from said upper coupling to said bit subassembly for entraining mineral specimens, and being provided with an outlet air passage for transfer of mineral-laden air from said bit subassembly to said upper coupling.

9. The drill string according to claim 8 wherein said bit subassembly is provided with a bit head having a collar which slip-fits within the bottom end of said outer casing during a drilling operation whereby the outer casing shields the interior of the bit head from bore hole contamination.

10. The drill string according to claim 9 wherein said bit head is provided with entraining air passages extending downwardly through the collar and opening at the bit head cutting face whereby entraining air communication from said interchanger subassembly to the bottom of the bore hole is attained, and said bit head is further provided with mineral-entrained air passages extending upwardly through the collar into the annulus between the drive hammer and the outer casing whereby the outer casing shields the mineral-entrained air from the bore hole wall.

11. The drill string according to claim 8 wherein the outer casing of said bit subassembly is provided with covered longitudinal passages along its outer periphery opening outward near its bottom end, said longitudinal passages being in fluid communication with an outer concentric passage in said upper coupling whereby drilling mud may be transferred from said upper coupling to a region near the bottom of the bore hole for lubrication.

* * * * *